United States Patent [19]

Blomsma

[11] 4,059,148

[45] Nov. 22, 1977

[54] PRESSURE-COMPENSATED DUAL MARINE RISER

[75] Inventor: Everhard C. Blomsma, Rijswijk, Netherlands

[73] Assignee: Shell Oil Company, Houston, Tex.

[21] Appl. No.: 733,553

[22] Filed: Oct. 18, 1976

[30] Foreign Application Priority Data

Dec. 30, 1975 United Kingdom ..... 53144/75

[51] Int. Cl.[2] ..... E21B 7/12

[52] U.S. Cl. ..... 166/.5; 175/27; 175/7; 166/208

[58] Field of Search ..... 175/5, 7, 27; 166/.5, 166/.6, 208

[56] References Cited

U.S. PATENT DOCUMENTS

| | | | |
|---|---|---|---|
| 2,607,422 | 8/1952 | Parks et al. | 166/.5 |
| 3,055,429 | 9/1962 | Tausch et al. | 166/.5 |
| 3,137,348 | 6/1964 | Ahlstone et al. | 166/.6 |
| 3,259,198 | 7/1966 | Montgomery et al. | 175/7 |
| 3,310,107 | 3/1967 | Yancey | 166/.6 |
| 3,486,555 | 12/1969 | Vincent | 166/.5 |
| 3,572,014 | 3/1971 | Graaf | 175/7 X |
| 3,721,292 | 3/1973 | Ahlstone | 166/.5 X |

*Primary Examiner*—Ernest R. Purser
*Assistant Examiner*—Richard E. Favreau

[57] ABSTRACT

A dual marine riser for use in drilling deepwater oil and gas wells from a floating vessel, the marine riser incorporating concentric inner and outer risers, the outer riser being provided with one or more remotely-actuatable valves adapted to bring the annular space between the risers into communication with surrounding sea water in order to equalize pressures over the wall of the outer riser when the inner riser has been installed.

13 Claims, 10 Drawing Figures

PRESSURE-COMPENSATED DUAL MARINE RISER

BACKGROUND OF THE INVENTION

The present invention relates to a marine riser system for use in off-shore drilling operations and to a method for installing the same.

Off-shore drilling operations that are carried out by means of drilling equipment aboard a floating drilling unit, such as a drill ship or a semi-submersible, often make use of a marine riser extending between the wellhead of the well that is being drilled in a subsea formation and the drill ship. Such marine riser is a tubular means made up of a plurality of tubular sections that are connected in end-to-end relationship. The riser, if installed between a ship and a wellhead, allows return of the drilling mud with drill cuttings from the hole that is being drilled. Also, the marine riser is adapted for being used as a guide means for lowering equipment (such as a drill string carrying a drill bit) into the hole. A riser may comprise concentric tubular strings of pipe as shown in U.S. Pat. No. 3,721,292.

The lower end of a marine riser is detachably connected to the wellhead and the upper end thereof is connected to the drill ship by means of a heave compensator which allows the marine riser to be tensioned by the drill ship without allowing overloading of the marine riser and the cables by which the riser is supported from the vessel by heave of the drill ship. If desired, a substantial part of the lifting force required to tension the marine riser may result from buoyancy members that are coupled to the riser sections and are constituted by low-density bodies which are preferably of annular or semi-annular shape to allow an easy handling of those riser sections that have a buoyancy member attached thereto.

During drilling of the hole, it is from time to time required to insert casing into the hole for protecting the hole against collapse of the wall or against inflow of high pressure formation fluid, or for preventing fracturing of the formation. Since the diameter of each additional casing that is inserted through a casing already present in the hole is smaller than the diameter of that latter casing, the diameter of the drilling equipment should also be decreased each time after an additional casing has been set. The riser through which the hole has been initiated often has a very large (up to 30 inches) inner diameter. If desired, this large-diameter riser may be replaced by a riser of smaller diameter in the later stages of the drilling operations when smaller-diameter drilling tools are used. However, since such replacement also requires replacement of additional equipment (such as kill and choke lines, blow-out preventers, telescopic joints, flexible joints), such replacement of the large-diameter riser by a small-diameter one is not considered attractive for economic reasons.

During progress of the drilling operations in a hole, formation pressures of increasing value will be met, which formation pressures call for increasing values of the mud pressure in the hole to maintain the pressure balance in the hole under control. Therefore, the specific gravity of the mud has to be increased from time to time, as a result of which the weight of the mud present in the marine riser is increased. Consequently, the difference between the specific gravities of the mud inside the marine riser and the sea water outside this riser will increase during the drilling operations. As the wall thickness of the riser is dictated by the longitudinal and bending loads to which the riser will be subjected, and the longitudinal loads are dictated by the weight of the riser, by the weight of the mud present in the riser, and by the pressure difference across the wall of the riser, it will be appreciated that the wall thickness of the riser should in particular be sufficiently large to meet the conditions existing in the last stage of the drilling operations, when the specific gravity of the mud has reached its maximum value for the particular drilling operation.

Further, since the mud pressure acting on the inner surface of the riser is being increased during the drilling operations as a result of the above-mentioned increases of the specific gravity of the mud, measures are to be taken to tension the riser sufficiently to prevent buckling thereof. Consequently, the force exerted by the riser tensioner (or heave compensator) will have to be increased each time the specific gravity of the mud is increased.

It has already been proposed in deep-sea operations to provide a tensioned liner string in the marine riser for reducing the flow area in the riser and thereby increasing the flow velocity of the mud to prevent or minimize settling of drill cuttings in the mud stream, and for relieving the riser of high mud pressures.

Object of the invention is a dual riser system for deep sea drilling, wherein a considerable reduction in the capacity of the marine riser tensioner can be obtained.

SUMMARY OF THE INVENTION

The marine riser system according to the present invention comprises two risers that are adapted to be vertically arranged with a substantially annular space there between, each riser consisting of a plurality of sections that are sealingly connected in end-to-end relationship, the outer riser comprising connecting means at the lower end thereof, said connecting means being adapted for connecting and sealing the lower end of the outer riser to a wellhead, said outer riser further comprising supporting means near the upper end thereof, said supporting means being adapted for being connected to a heave compensator system carried by a floating drilling means, sealing means being arranged for sealing off the annular space at, at least, the lower end thereof, and closable fluid pressure equalizing means arranged in the wall of the outer riser, said means being adapted for equalizing the fluid pressures prevailing in the annular space and in the space outside the outer riser.

It will be appreciated that since the fluid pressure equalizing means allow equalization of the fluid pressures prevailing in the space outside the outer riser and in the annular space between the inner and outer riser, this outer riser will over the period that drilling mud having a relatively high specific gravity is being circulated through a hole, not be subjected to any pressure differences over the wall thereof. Consequently, the wall thickness of this riser can be chosen smaller than the thickness that would be required when the drilling mud with relatively high specific gravity would be in contact with the inner wall of this riser.

In the absence of drilling mud in the annular space between the risers, the load tending to buckle the outer riser is decreased which allows a reduction of the required tensioning force.

The inner riser may be equipped with bouyancy means to further reduce the required capacity of the heave compensating means supporting the risers.

The marine riser system according to the invention may be installed between a floating drilling means and a submerged wellhead by the steps of:

a. suspending the outer riser from the floating drilling means by means of a heave compensating system mounted on the floating drilling means, the lower end of the outer riser being above the submerged wellhead to which it is to be coupled;
b. placing the lower end of the outer riser on the wellhead and coupling this lower end of the outer riser to this wellhead;
c. lowering the inner riser through the outer riser to a position wherein the inner riser is enclosed by the outer riser, and sealing off the annular space between the outer and inner riser near both ends of this annular space; and
d. manipulating the pressure equalizing means to equalize the fluid pressures prevailing in the annular space and outside the outer riser.

BRIEF DESCRIPTION OF THE DRAWING

The invention will hereinafter be described in more detail by way of example with reference to some embodiments of the invention shown in the various figures of the drawings.

FIG. 9 shows the outer riser in position during the initial drilling operations, whereas

Figure 2:
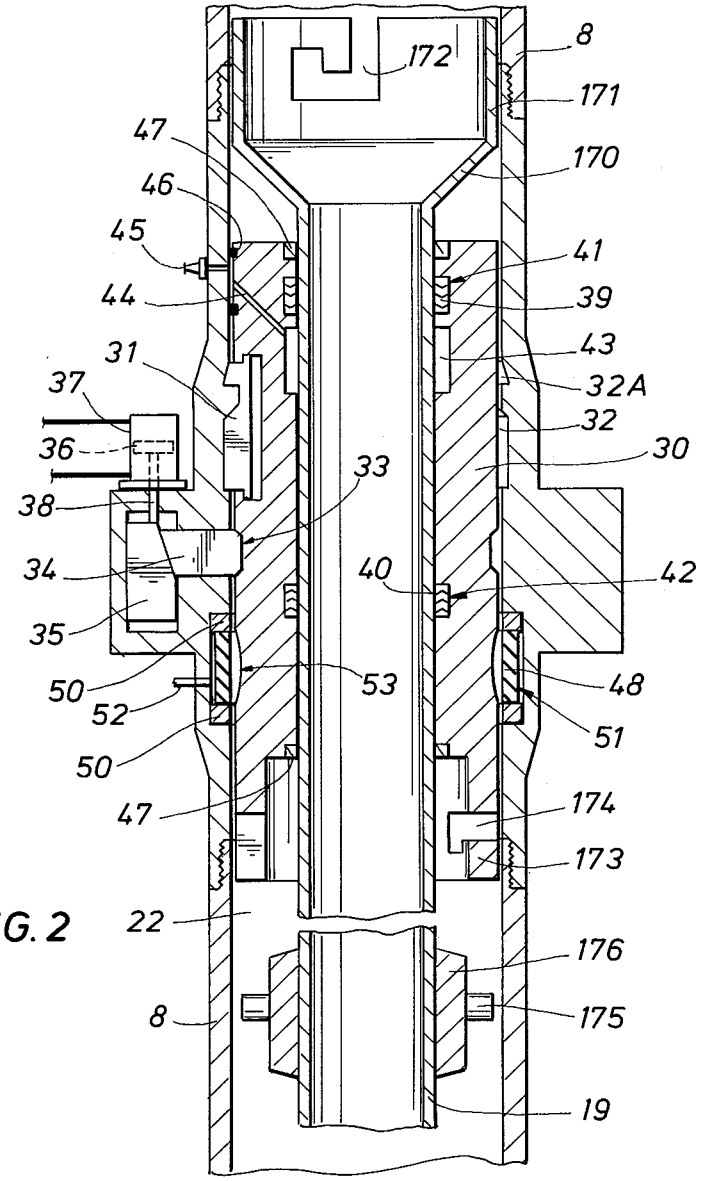
FIG. 2 shows schematically in more detail particulars of the means A of the riser system shown in FIG. 1.

The base member 1 (see FIG. 1) situated on the sea bottom 2 is connected to the casinghead 3 which supports the blow-out preventer 4, Casing 5 is suspended (in a manner known per se) from the casinghead 3 and extends downwards in the hole 7 that is being drilled in the sea bottom 2.

The outer or large-diameter riser 8 of the marine riser system according to the invention extends from a semi-submersible 9 (known per se and only for a small part thereof shown in the drawing) to the wellhead 10, of which blow-out preventer 4 and casinghead 3 form a part. The lower end of the riser 8 is connected to the wellhead 10 through the intermediary of a flexible joint 11 and a remotely detachable coupling 12. Since various types of couplings that can be coupled and uncoupled by remote control means are known for underwater operations, no details of coupling 12 are shown in the drawing. Further, various types of flexible joints are known, which joints when coupled between a marine riser and a wellhead allow the central axis of the riser to deviate from the central axis of the wellhead. Any type of joint, such as a ball joint, that is suitable for the purpose may be used in the embodiment of the invention shown in FIG. 1.

The upper end of the outer riser 8 is connected to hydraulic cylinders 13, 13' via cable 14, 14' running over idle sheaves 15, 15'. The cylinders, cables and sheaves are part of a heave compensator that is located aboard the semi-submersible 9, which heave compensator allows vertical displacements of the semi-submersible 9 with respect to the sea bottom 2 whilst maintaining a constant load on the cables 14, 14' and consequently a constant tension in the outer riser 8. Thereto, a constant fluid pressure is maintained in the space below the pistons 16, 16' of the heave compensator. It will, however, be appreciated that the present heave compensator is shown by way of example only, and that any other type of heave compensator may be applied as well.

For sake of simplicity, the drilling equipment and derrick required for drilling the hole 7 are not shown in the drawing. The upper end of the outer riser 8 is in fluid communication with the drilling equipment aboard the semi-submersible 9 via the telescopic member 17 that has a flexible joint 17A incorporated therein for compensating any misalignment that may occur between the central axis of the outer riser 8 and the upper end of the telescopic member 17.

Buoyancy members 18 are connected to the outer wall of the riser 8. These buoyancy members may be of any construction suitable for the purpose. The specific gravity thereof is smaller than the specific gravity of the water. Thus, the submerged weight of the riser 8 is reduced and a heave compensator can be applied which has a capacity smaller than would be required if no buoyancy members were used. It is observed that the invention is not restricted to marine riser systems applying buoyancy members connected to an outer riser that is made of steel pipe. In case a light-weight outer riser 8 would be applied (which riser may be constructed of reinforced resin), only a small number of buoyancy members, or no buoyancy members at all, will be required.

Figure 1:
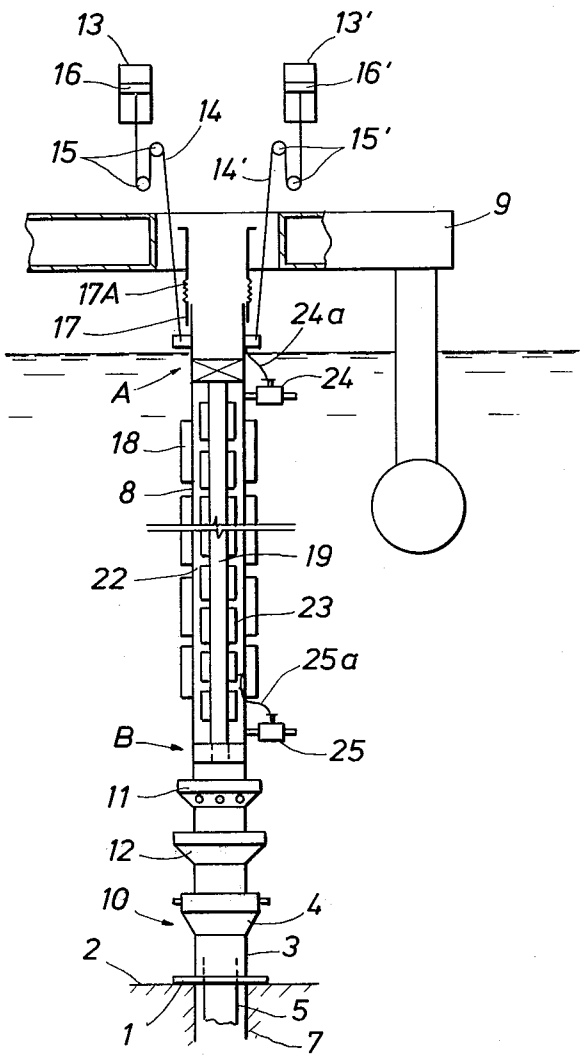
FIG. 1 shows schematically (partly in longitudinal section) a marine riser system wherein the annular space between the risers is sealed off at both ends, and valve means are provided that are adapted for bringing this annular space into communication with the surrounding sea water.

The marine riser system shown in FIG. 1 further comprises an inner riser 19 connected at the ends thereof to the outer riser 8 by means A and B sealing off the annular space 22 present between the risers 8 and 19. Buoyancy members 23 are attached to the inner riser 19 to reduce the submerged weight thereof. A smaller number of members 23 may be applied in case a light-weight type of riser 19 is being used. If desired, the buoyancy members 23 may be omitted.

Valve means 24 and 25 are mounted on the outer riser 8 near the upper end and lower end thereof, respectively. These valve means are remotely controllable in a manner known per se. For example, the valves 24 and 25 may be actuated from the vessel 9 either electrically or hydraulically through conduits **24*a* and 25*a*, respectively, extending from the valves to the vessel. Both valve means, when in the open position, allow fluid communication between the annular space 22 and the sea water outside the outer riser 8**.

It will be understood that the inner riser and the outer riser that have been shown in the drawing each consist of a plurality of riser sections that are connected in end-to-end relationship. Each riser section has coupling means at both its ends, these coupling means allowing sealingly intercoupling of riser sections of a common diameter to form a marine riser. Since various couplings are well known for this purpose, no details thereof will be described herein. The same applies for the kill and choke lines that are applied, as well as for the umbilical line through which energy and signals may be passed from the floating drilling means to the various components of the wellhead and other submerged devices (such as the remotely controllable valves 24,25) that need to be activated from time to time during the drilling operations.

Figure 3:
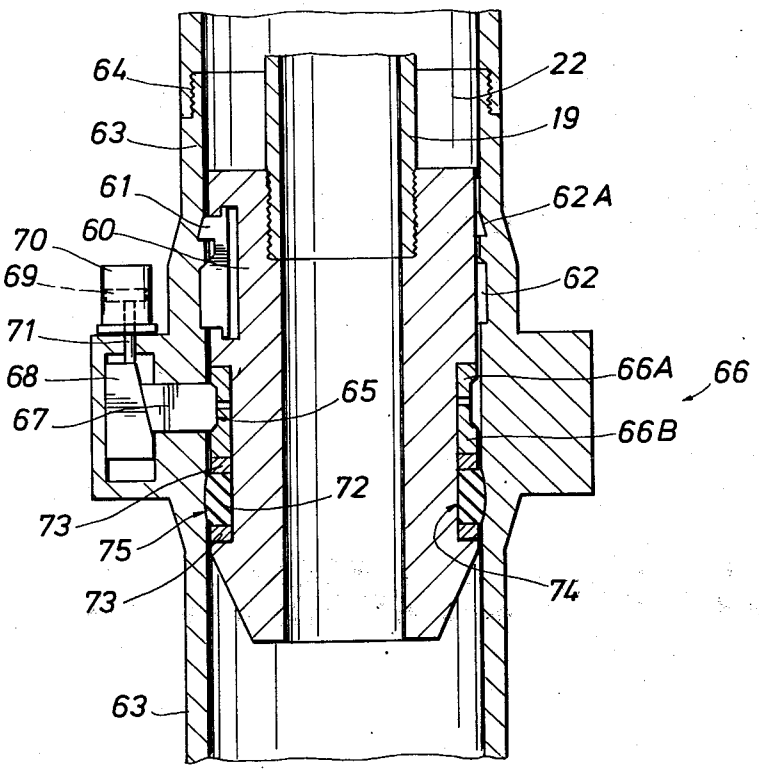
FIG. 3 shows schematically in more detail particulars of the means B of the riser system shown in FIG. 1.
Figure 7:
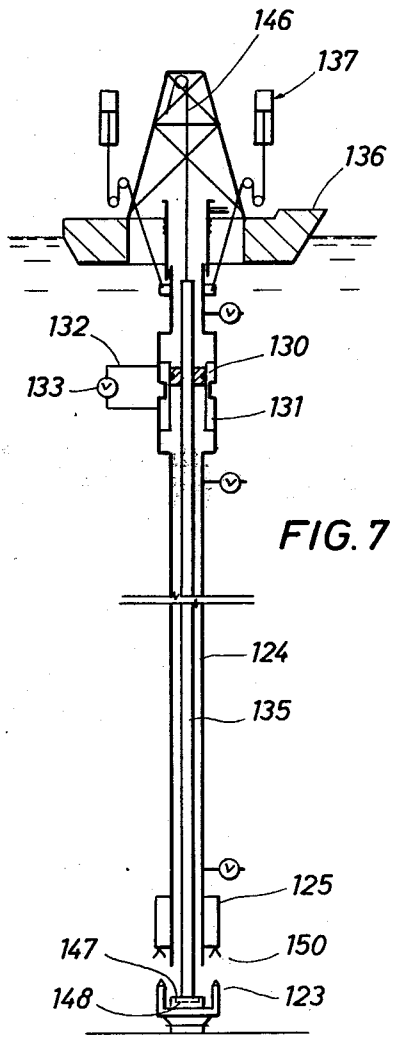
Figure 6:
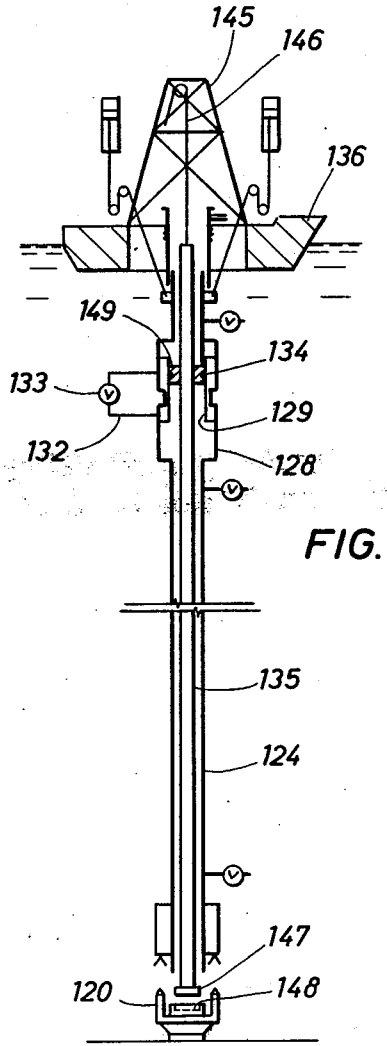

Details of one embodiment of the means A and B (see FIG. 1) are shown in FIGS. 2 and 3, respectively. The particular means shown in FIGS. 2 and 3 allow the use of a so-called "standing" inner riser 19. The lower end of the inner riser 19 is thereby sealingly connected to the outer riser 8 such that relative axial displacement between the lower parts of the risers 8 and 19 is prevented. To allow changes in length of the risers resulting from variations in temperature, pressure, load, etc., the upper means A is designed as a slip joint.

The means A of FIG. 1 may be formed by the sealing means shown in FIG. 2. This sealing means comprises an annular body member 30 arranged in the annular space 22 present between the risers 8 and 19. The body member 30 carries springloaded keys 31 adapted for co-operation with grooves 32 and 32A in the inner wall of the outer riser 8. A groove 33 is arranged in the outer wall of the body member 30 and adapted to co-operate with locking dogs 34 (only one of which is shown in the drawing). Each locking dog can be pushed into the groove 33 by means of a wedge 35 (only one of which is shown). Each wedge 35 is connected to a piston 36 of a hydraulic cylinder 37 via a rod 38.

Packer seals 39 and 40 are arranged in grooves 41 and 42, respectively, which grooves are situated in the inner wall of the body member 30. These seals seal against the outer wall of the inner riser 19. An annular groove 43 is further provided in the inner wall of the body member 30, which groove communicates via a passage 44 with an injection nipple 45 mounted on the outer riser 8. Seals 46 are arranged on the outside wall of the body member 30 to seal against the inner wall of the outer riser 8 so as to prevent leakage of lubricating compound injected through the nipple 45.

Scrapper rings 47 are mounted on the ends of the body member 30 to clean the outer surface of the inner riser 19, when this riser moves through the body member 30 due to expansion or contraction of one or both of the risers 8 and 19.

An inflatable packer 48 is arranged in the inner wall of riser 8 to seal off the annular space between the body member 30 and the riser 8. The packer is arranged between rings 50 mounted in the annular recess 51 of the riser 8. Pressure fluid to inflate the packer can be supplied from a suitable source through flexible tube 52. When inflated, the packer 48 co-operates with the shallow groove 53 arranged in the outer wall of the body member 30.

The upper end of the inner riser 19 carries a conical entry guide 170 combined with a cylindrical part 171 provided with J-slots 172 for co-operation with pins (not shown) mounted on a tubing (not shown) adapted for lowering the inner riser 19 in place.

The lower end of the housing 30 carries an extension 173 with J-slots 174 for co-operation with pins 175 carried by a sleeve member 176 mounted on the inner riser 19.

The means B of FIG. 1 may be formed by the sealing and connecting means shown in FIG. 3. This means comprises an annular body member 60 which is connected to the lower end of the inner riser 19. The body member 60 carries keys 61 that are (for reasons that will be explained hereinafter) of greater length than the keys 31 of sealing means shown in FIG. 2. The keys 61 are springloaded and adapted to co-operate with grooves 62 and 62A in the inner wall of the housing 63 that is connected by means of a coupling 64 to the lower end of the riser 8. A groove 65 is arranged in a two-part ring member 66 carried by body member 60, to co-operate with locking dogs 67 (only one of which is shown in the drawing). Each locking dog 67 can be pushed into the groove 65 by means of a wedge 68. Each wedge 68 is connected to a piston 69 of a hydraulic cylinder 70 via a rod 71. Further, a packer member 72 clamped between rings 73 is arranged in co-operative arrangement with the ring member 66 in an annular recess 74 of body member 60 in a manner such that when the locking dogs 67 are in locking position with the groove 65, the packer member 72 will be compressed by the lower ring 66B of the two-part ring member 66 under influence of the force exerted by the locking keys 67 on the two parts 66A and 66B of the ring member 66. As shown in the drawing, the packer member 72 is expanded thereby and seals off against the shallow groove 75 arranged in the inner wall of the housing 63.

The lower end of the housing 63 is connected in a suitable manner (not shown) to the flexible joint 11 (see FIG. 1).

The manner of installing the marine riser system of FIG. 1 between the floating drilling means 9 and the wellhead 10 will now be described. The means A and B of the marine riser system consist of the means shown in FIGS. 2 and 3, respectively.

First of all, the outer riser 8 is lowered from the semi-submersible 9 in the water by means of the derrick (not shown) carried by the semi-submersible. The lower end of the outer riser 8 carries the housing 63 (see FIG. 3), the flexible joint 11 (see FIG. 1) and part of the coupling 12 (see FIG. 1). During lowering of the outer riser, additional riser sections are coupled thereto at the upper end thereof (at least part of these sections having buoyancy members 18 connected thereto) until the two parts of the coupling 12 meet and are coupled to each other by remote control.

It will be appreciated that any technique of guiding the lower end of the riser 8 that is being descended through the water onto the wellhead 10 may be applied for this purpose.

The upper end of the riser 8 is suspended from the semi-submersible 9 by means of the heave compensating system 13, 13', 14, 14', 15, 15', 16, 16'. The telescopic joint 17 is placed on top of the riser 8 to ensure a fluid communication between the interior of the outer riser 8 and drilling means (not shown) mounted on the semi-submersible 9.

Subsequently, the hole 7 is drilled by drilling tools that are lowered through the outer riser 8. Thereto, the riser is filled with drilling mud. After a certain depth has been reached, the casing 5 is set. Drilling is continued and, if necessary, additional casings are set. During the drilling operation, the specific gravity of the drilling mud, circulating through the drill string (not shown), the hole 7 and the outer riser 8, is increased as qictated by the conditions that are met during the penetration of the hole through the formations.

A critical value of the specific gravity of the mud will be reached when the total weight of the mud present in the outer riser 8 tends to buckle the riser 8, or when the hydraulic presesure inside the riser has risen to a value that cannot be withstood by the riser. Prior to reaching this critical value, the drilling operations are halted, and the drilling tools are retracted from the hole 7 and the riser 8. Valves 24 and 25 are subsequently opened by remote control, and the mud flows from the interior of riser 8 via the valve 25 and sea water enters the interior of riser 8 via the valve 24. After the mud has been removed from the riser 8, the inner riser 19 is lowered into the riser 8 and set in the position shown in FIG. 1.

The blow-out preventer 4 is preferably, but not necessarily, closed during the above-described procedure of mud removal and setting of the riser 19.

Further, it is observed that the mud may also be removed from the outer riser 8 by running a tubing string into the riser 8 until the lower end of this string is situated at or near the level of the flexible joint 11. By pumping water through the tubing string, the mud present in the annular space between the riser 8 and this string will be displaced upwards and out of the riser 8. Thereafter, the valves 24 and 25 are opened and the tubing string is removed from the riser 8.

To set the inner riser 19 in the position shown in FIG. 1, this riser is lowered into the riser 8 in a manner known per se by coupling riser sections to the top thereof. The lower end of the riser 19 carries the means B which consists of the sealing and connecting means shown in FIG. 3. Since the keys 61 of the sealing means of FIG. 3 are of greater length than the keys 31 and the groove 32 of the means shown in FIG. 2, these keys 61 will not lock in the groove 32, but pass freely along this groove 32. After a certain length of riser 19 has been assembled, the means of FIG. 2 (sealing means A) will be mounted on the riser 19 in a position wherein pins 175 are in locking arrangement with the J-slots 174 of the extension 173 of the housing 30. Further riser sections are then added to allow lowering of the riser 19, and the sealing means A is displaced downwards until the keys 31 of sealing means A meet the grooves 32 and 32A and lock therein under spring action. Pins 175 are subsequently unlocked from J-slots 174. The conical entry 170 together with cylindrical extension 171 is then mounted on top of the inner riser 19 and this riser is lowered by means of a tube (not shown) carrying pins (not shown) co-operating with the J-slots 172 in the cylindrical extension 171. This downward movement of the riser 19 allows the keys 61 of sealing and connecting means B to meet the grooves 62 and 62A and lock therein. The groove 65 formed between the parts 66A and 66B of the ring member 66 then faces the locking dogs 67. Actuation of locking dogs 67 by energizing the pistons 69 in cylinders 70 will push the parts 66A and 66B of the ring member 66 apart, thereby compressing the seal 72 and sealing off the fluid passage between the annular body member 60 and the housing 63. The keys 61 will be released of any load when the dogs 67 are in the locking position.

The pins co-operating with the J-slots 172 are subsequently uncoupled and the tube carrying these pins is retracted.

Activation of the pistons 36 (see FIG. 2) results in inward movement of locking dogs 34, thereby locking in the groove 33 and releasing the keys 31 of any load. By applying fluid pressure to packer 48 via the flexible tubing 52, the passage between the outer riser 8 and body member 30 is closed off. Since the passage between the outer riser 19 and the body member 30 is sealed off by packers 40 and 41 of sealing means A (see FIG. 2), the upper end of the annular space 22 is protected against entry of mud. If desired, a lubricant may be injected into the groove 43 via the nipple 45 and the conduit 44.

The annular space 22 between the risers 8 and 19 containing water, the pressure outside and inside the riser 8 will be equal over the length thereof extending between the sealing means A and B.

The riser 8 now needs to be tensioned only to prevent buckling thereof under influence of the weight of the dual riser system and the weight of the mud present in the inner riser 19. The required tensional force to be exerted on the riser 8 is considerably smaller than the tensional force to be exerted in case the annular space between the risers would contain mud. The tensional force is further reduced by providing buoyancy means 23 around the inner riser 19.

In an alternative embodiment (not shown) of the invention, the inner riser may be connected at the upper end thereof to the outer riser by a coupling and sealing means which prevents displacement between the risers. Further, the lower end of the inner riser may be sealed against the inner wall of the riser by means of a sealing arrangement which allows a displacement of the lower end of the inner riser with respect to the outer riser. The major part of the weight of the inner riser may be compensated by buoyancy means. The remaining part of the weight of the inner riser will then be supported from the outer riser via the coupling interconnecting the upper ends of the risers.

It will be appreciated that a coupling and sealing means of the type shown in FIG. 3 may be installed near the upper ends of the risers, and a sealing means of the type shown in FIG. 2 may be used between the lower ends of the risers. The keys of the sealing means arranged near the lower ends of the risers and the annular recess arranged near the upper end of the outer riser should be shaped in a manner to prevent any coupling interaction between them during installation of the inner riser.

Undesired stresses in the risers resulting from temperature and/or pressure variations will be prevented when applying sealing means shown in FIG. 2 as sealing means A in FIG. 1. An alternative construction of such sealing means, which construction allows tensioning of the inner riser by means of a hydraulic cylinder, is shown in FIG. 4 of the drawings.

Figure 4:
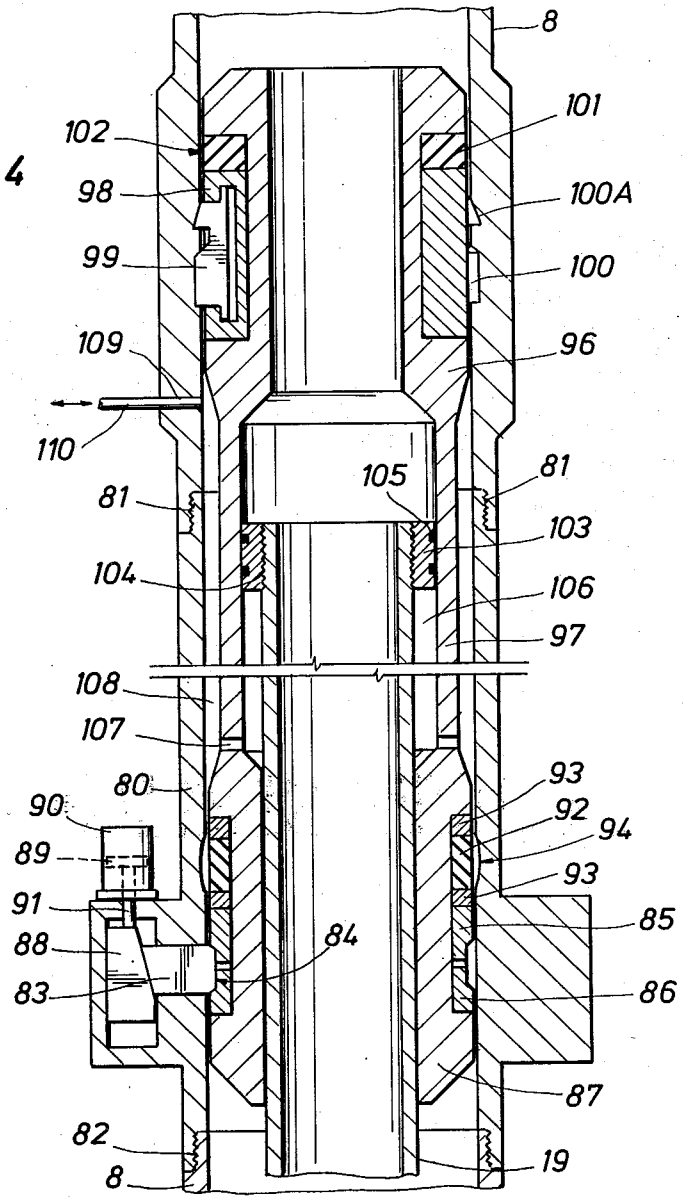
FIG. 4 shows an alternative of the means A shown in FIG. 2.

Just as the sealing means of FIG. 2, the sealing means shown in FIG. 4 allows length variations of the risers 8 and 19. The sealing means in FIG. 4 is arranged between the outer riser 8 and the inner riser 19. A housing 80 is inserted by suitable coupling means 81, 82 between two of the riser sections situated in the upper part of the riser 8. This housing 80 carries locking dogs 83 adapted for co-operation with a groove 84 arranged between the ring members 85, 86 carried by annular member 87. Only one locking dog 83 is shown in the drawing. The locking dog is in contact with a wedge 88 that can be displaced in axial direction by a piston 89 arranged in a hydraulic cylinder 90 and connected to the wedge 88 by a piston rod 91.

The annular member 87 further carries a packer member 92 situated between two rings 93. The packer member 92 will be compressed to seal off against the shallow groove 94 in the inner wall of the housing 80 by an axial force exerted on the lower ring 93 when the locking dogs 83 enter the groove 84 between the ring members 85, 86.

The annular member 87 is connected to the annular member 96 by means of a cylindrical sleeve 97. The annular member 96 carries a ring member 98 provided with a number of keys 99 (only one of which is shown) that are pressed outwards by means of springs (not shown). In the position shown, each key 99 co-operates with the grooves 100 and 100A. The annular member 96 further carries a packer member 101 that will be compressed to seal off against part 102 in the inner wall of the riser 8 by a downward axial force exerted on the annular member 96 when the keys 99 are in engagement with the grooves 100 and 100A and the locking dogs 83 enter the groove 84 between the ring members 85,86.

An annular piston 103 is mounted by suitable coupling means 104 on top of the riser 19. The piston 103 is provided with seals 105 that seal off against the inner wall of the cylindrical sleeve 97. An annular cylinder space 106 is thereby formed, which space communicates via a passage 107 with the annular space 108. Hydraulic fluid can be supplied to and drained from the space 108 via opening 109 and conduit 110.

When applying the sealing means according to FIG. 4 as sealing means A in FIG. 1, in combination with the sealing and connecting means of FIG. 3 as means B, the inner rise 19 is run into the outer riser 8 prior to the moment that the specific gravity of the mud is raised to the critical value thereof. The lower end of the inner riser 19 carries inter alia the keys 61 shown in FIG. 3, which keys since being longer than the keys 99 shown in FIG. 4, can pass the groove 100 when the riser 19 is inserted into the riser 8. The riser 19 is built up by adding riser sections to the top thereof and lowering the riser in a manner known per se. On arrival of the keys 61 (see FIG. 3) at the level of the grooves 62, 62A, the keys are pressed into these grooves and the riser 19 is prevented from moving further downwards. Then, the locking dogs 67 are actuated to couple with the groove 65 between the parts 66A and 66B of the ring member 66 by activating the pistons 69 in hydraulic cylinders 70.

The piston 103 (see FIG. 4), together with the annular members 87 and 96 interconnected by the cylindrical sleeve 97 have been set on top of the riser 19 prior to the moment that the top of the riser 19 enters the top of the riser 8 (or the top of the telescopic member 17 if such member is applied — see FIG. 1). The keys 99 contact grooves 100 and 100A and prevent further downward movement of the annular member 96 and the annular member 87 connected thereto by means of the cylindrical sleeve 97. Subsequently, the dogs 83 are actuated into engagement with the groove 84 between the ring members 85, 86, by activating the pistons 89 in the hydraulic cylinders 90. As a result thereof, the annular members 87 and 96 are locked to the outer riser 8 and sealed there against by activation of seals 92 and 101, respectively.

To tension the inner riser 19, pressure fluid is supplied to the annular cylinder 106 via conduit 110, opening 109, space 108 and opening 107. This pressure fluid exerts an upward force against the piston 103, thereby tensioning the riser 19.

If desired, a low fluid pressure may be maintained in the space 106 of the means shown in FIG. 4. Then, the sealing means shown in FIG. 4 will act as a slip joint.

It will be appreciated that the invention, as far as related to the application of an inner riser that is tensioned by hydraulic means of the type shown in FIG. 4 of the drawings, is not restricted to the application of the particular construction shown in FIG. 4. Any other type of means that is adapted for maintaining an axial force of constant value to tension the inner riser of the riser system according to the invention may be applied. Instead of mounting the piston on the inner riser as shown in FIG. 4, the piston may be mounted on the inner wall of the outer riser or on the inner wall of a housing that is inserted between adjacent riser sections of the outer riser. Such type of construction will be described hereinafter with reference to FIGS. 5–10 of the drawings.

If necessary, more than one piston may be applied for raising the required force to tension the inner riser. The pistons are then connected to a common riser (such as the inner riser) and co-operate with and equal number of hydraulic cylinders that are connected to or form part of the other riser of the riser system.

Reference is now made to FIGS. 5–10 of the drawing, which show the use that can be made of a riser tensioner when lowering the outer riser of the riser system on a submerged wellhead.

The wellhead 120 mounted on the casing 121 above the seabed 122 carries centering means 123 adapted for co-operating with the lower end of the outer riser 124 of the riser system. This lower end carries coupling means, blow-out preventer means and a flexible joint (all these means being schematically indicated by reference numeral 125). A hydraulic piston/cylinder arrangement 126 is incorporated in the outer riser 124 near the upper end thereof. An annular piston 127 is mounted on the inner wall of the housing 128, and an annular cylinder 129 that is movably arranged in the housing 128 co-operates with the piston 127. Hydraulic lines (not shown) are in communication with the two cylinders spaces 130, 131 to control entry of pressure fluid to these spaces as well as drainage of fluid therefrom. Also, these cylinder spaces can be brought into communication with each other via a bypass conduit 132 with valve 133. Suitable sealing means (not shown) are present in the piston/cylinder arrangement 126 where necessary to prevent leakage of hydraulic pressure fluid therefrom. Also, the cylinder 129 carries coupling means 134 (schematically indicated in FIG. 6) adapted for coupling the cylinder 129 to a tubular means 135 passing therethrough.

The upper end of the outer riser 124 is suspended from the drilling vessel 136 by means of tensioners 137, each tensioner comprising a cylinder 138, a piston 139, a piston rod 140, a cable 141 and idle sheaves 142 that are rotatably mounted on the vessel 136. The interior of the riser 124 communicates with a mud tank (not shown) via a telescopic joint 143 and a diverter 144 attached thereto.

Figure 5:
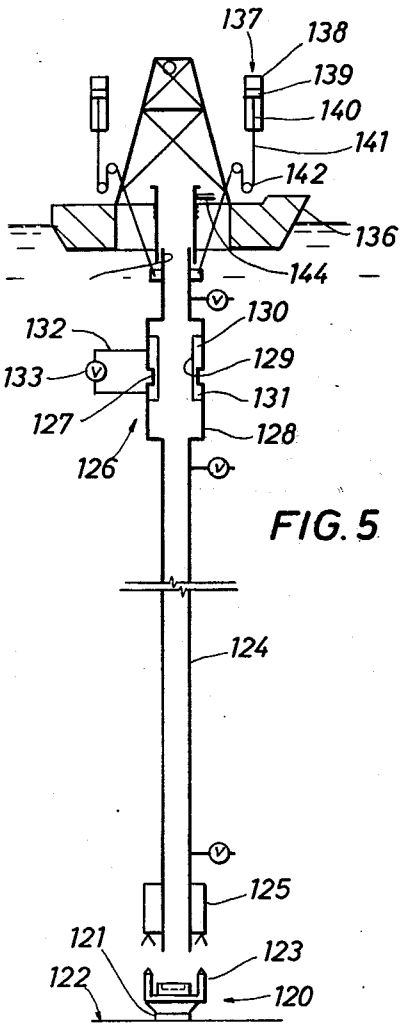
FIG. 5 shows schematically in longitudinal section the outer riser of the marine riser system of the invention in the position when being supported by the drilling vessel. The various positions of this riser and a means applied for guiding and landing the outer riser on a wellhead are shown in FIGS. 6–8.
Figure 10:
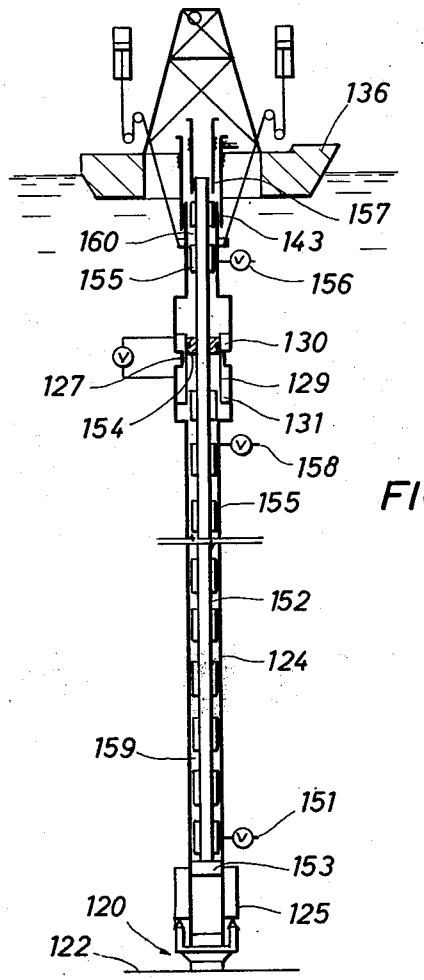
FIG. 10 shows the marine riser system during a later stage of the drilling operations when the inner riser has been installed.

After the outer riser 124 has been suspended in the position shown in FIG. 5, the heave compensator 137 is controlled to support the weight of the riser 124. Due to heave of the vessel, the lower end of the riser 124 carrying the coupling means 125 will be displaced in vertical direction above the wellhead 120.

Subsequently a tubular member 135 (see FIG. 6) consisting of a plurality of tubular sections that are screwed together by screw threads carried at the ends of each section, is lowered from the vessel 136 through the riser 124. The tubular member 135 is suspended from the derrick 145 on the vessel 136 via a cable 146 which is part of the hoisting system that includes a compensating system (not shown) allowing to maintain a constant tension on the cable 146. The lower end of the tubular means 135 carries a coupling member 147 adapted to co-operate with the coupling part 148 to the wellhead 120, when the two elements are in contact with each other.

Further, the tubular member 135 carries a housing 149 with coupling means 134 that are remotely controllable to connect the tubular member 135 to the cylinder 129.

After coupling the tubular member 135 to the cylinder 129 (see FIG. 6), the tubular member 135 is lowered by lowering the cable 146. The valve 133 in the bypass 132 is open, which allows the housing 149 and the annular cylinder 129 to be displaced freely with respect to the housing 128. The coupling unit 147 is then seated on the unit 148 of the wellhead 120 and coupled thereto (see FIG. 7), and the influence of heave on the tension in cable 146 is compensated by a heave compensator (not shown) co-operating with the hoisting system, including the cable 146.

Valve 133 in by-pass 132 is then slowly closed, which results in hydraulically coupling the outer riser 124 to the tubular member 135. Thereby, the heave compensators 136 come into action to maintain a constant tension in the cables 141 carrying the outer riser 124, independently of the heave of the vessel 136.

Subsequently, hydraulic pressure fluid is supplied to the cylinder space 130. The outer riser 124 is thereby lowered in a controlled manner, which allows the coupling 125 with centering means 150 (see FIG. 8) to be gently lowered on the centering means 123 of the wellhead 120. After the correct orientation has been reached between the coupling 125 and the wellhead 120, the coupling 125 is coupled to the wellhead (see FIG. 8).

Figure 9:
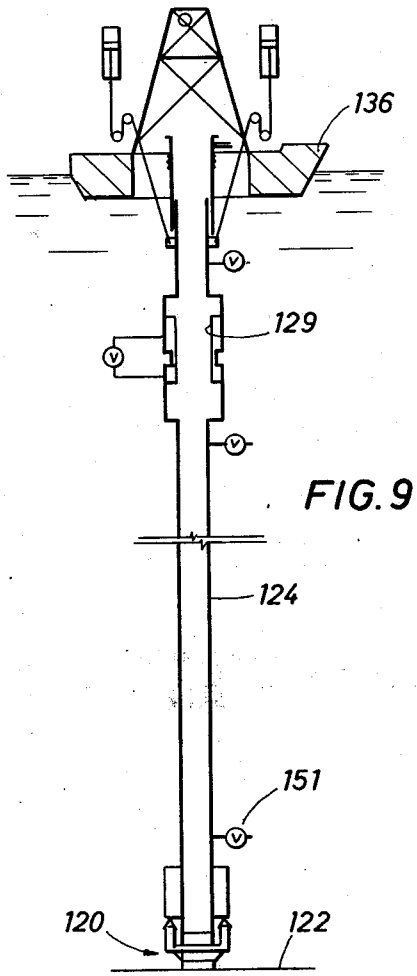
Figure 8:
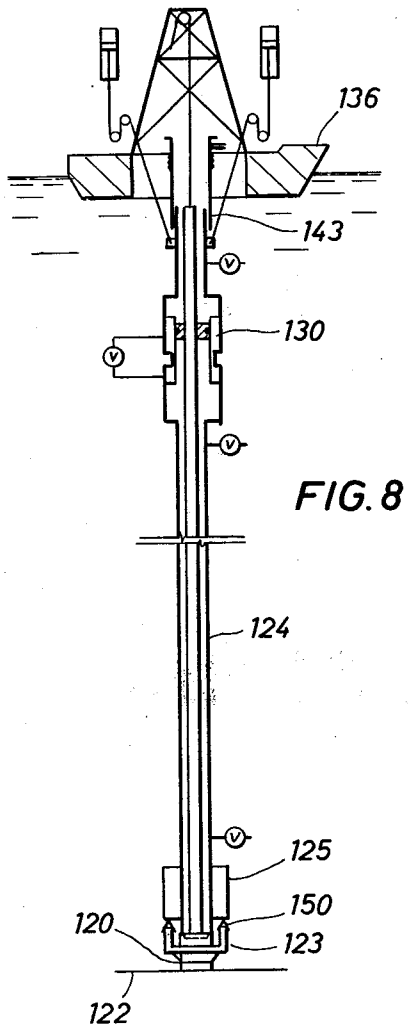

The tubular member 135 is then detached from the cylinder 129 and the wellhead 120 and removed from the outer riser 124 (see FIG. 9). Drilling of a hole is subsequently initiated by passing a drill string (not shown) with a drill bit through the riser 124 and the wellhead 120 into the seabed 122, and circulating the drilling mud through the string. After one or more casing (not shown) have been set in the hole, a critical value of the specific gravity of the drilling mud will be reached, which will necessitate the drilling operator to insert an inner riser in the outer riser 124 for protecting this outer riser against mud of high specific gravity. Thereto, the drill string with drill bit is retracted from the hole and the blow-out preventer that forms part of the coupling means 125 at the lower end of the riser 124 is closed. Drilling mud is drained from the interior of the outer riser 104 by opening the valve 151 (see FIG. 9) in the well of the riser 104 near the lower end thereof. Sea water is simultaneously supplied to the top end of the telescopic joint 123 by pumping means aboard the vessel 116. After the drilling mud has been replaced by sea water, the inner riser 152 (see FIG. 10) is lowered into the outer riser 124. If desired, the tubular sections of the tubular member 135 may be used for this purpose. The inner riser 152 is coupled to the lower end of the outer riser 124 by means of a means 153 of the type shown in FIG. 3. Also, the inner riser 152 is coupled to the cylinder 129 by remotely controllable coupling means mounted on a housing 154 connected to or forming part of the riser 152.

Subsequently, hydraulic pressure fluid is supplied to the cylinder space 130 to tension the inner riser 152. Part of the submerged weight of the inner riser 152 is neutralized by the presence of buoyancy members 155 attached thereto.

The interior of the annular space 160 situated above the housing 125 is brought in communication with the outside of the outer riser 124 by opening the valve 156 in the wall of the upper end of the riser 124, thereby allowing a pressure equilibrium over the wall of the outer riser. Any variation in length of the risers 124 and 152 due to difference in temperature between the sea water and the mud, results in a vertical displacement of the cylinder 129 with respect to the piston 127, and consequently in a volume variation of the annular space 159 and 160 situated respectively below and above the cylinder 129. However, since the valves 151 and 156 remain open during the drilling operations, the pressure equilibrium across the wall of the outer riser 124 is not disturbed by these variations in length of the risers.

Communication between the interior of the inner riser 152 and the drilling equipment (not shown) aboard the drilling vessel 136 is obtained via the telescopic joint 157.

Drilling operations are resumed by lowering the drill string with drill bit (not shown) into the inner riser 152 and removing the water from the interior of the riser 152 by circulating drilling mud through the drill string.

Subsequently, the blow-out preventer in the coupling unit 125 is re-opened and the drill string with drill bit is further lowered to enter the hole.

It is observed that in an alternative method carried out by the equipment shown in FIGS. 5–10 of the drawing, the mud is not replaced by water prior to running in the inner riser 152, but at a later stage of the operations. Thereto, in the situation shown in FIG. 9, the blow-out preventer forming part of the wellhead 120 is closed and the inner riser 152 is entered into the outer riser 124 and set and tensioned in the manner described with reference to FIG. 10. Thereafter, the valves 151 and 158 are opened to allow mud to be displaced from the annular space 159 situated below the housing 154 and between the risers 124 and 152.

Further, valve 156 is opened and sea water is pumped into the top of the annular space 160 existing between the telescopic joints 143 and 157. After the spaces 159 and 160 have both been filled with water, the pressures inside and outside the outer riser 124 will be equalized and relatively small tensional load will be required to prevent buckling of the outer riser. Because the valves remain open during drilling operations, the pressures at both sides of the wall of the outer riser 124 remain equalized notwithstanding the fact that the lengths of the risers 124 and 152 are not constant due to temperature differences. These variations in length result in a vertical displacement of the cylinder 129 and consequently in volume variations of the annular spaces 159 and 160 situated respectively below and above the cylinder 129.

Damage of the coupling 125 is obviated during releasing this coupling from the wellhead 120 by carrying out the steps described with reference to FIGS. 5–10 in the reverse order.

It will be appreciated that during the drilling process after the inner riser has been set, all drilling mud passes through the inner riser 152. Since the diameter of this riser is considerably smaller than the diameter of the outer riser 124, it will be appreciated that the required wall thickness enabling the inner riser to withstand the use of high-density drilling mud is considerably smaller than the wall thickness that would have to be applied in the outer riser if this riser would have to be used for the passage of the same high-density mud.

When applying the riser system according to the invention, no mud is present in the outer riser during the period over which the drilling operations take place with a mud of relatively high specific gravity. Consequently, the required tensional force to be applied to the outer riser to prevent buckling thereof is relatively low and the capacity of the tensioners or heave compensators suspending the outer riser can for part thereof be applied for tensioning the inner riser which contains mud of relatively high specific gravity.

The flow passage through the valves that are provided for creating a communication between the annular space and the sea water should be sufficiently great to allow the passge of any mud that may leak out of the inner riser (through damaged riser couplings, etc.) into the annular space. It will be apprecited that a build-up of a mud column in the annular space is to be prevented since this will crease the risk of buckling of the outer riser. The outflow of mud from the annular space will be promoted if the annular space is in communication with the sea water at a level near the lower end of the space as well as at a level near the upper and thereof.

I claim as my invention:

1. Marine riser system for use in offshore well drilling operations, said system comprising two risers that are adapted to be vertically arranged with a substantially annular space therebetween, each riser consisting of a plurality of sections that are sealingly interconnected in end-to-end relationship, the outer riser comprising connecting means at the lower end thereof, said connecting means being adapted for connecting and sealing the lower end of the outer riser to a wellhead, said outer riser further comprising supporting means near the upper end thereof, said supporting means being adapted for being connected to a heave compensator system carried by a floating drilling means, sealing means being arranged for sealing off the annular space at, at least, the lower end thereof, and closeable fluid pressure equalizing means arranged in the wall of the outer riser, said means being adapted for equalizing the fluid pressures prevailing in the annular space and in the space outside the outer riser.

2. Marine riser system according to claim 1, wherein the pressure equalizing means comprises at least one closeable passage arranged near the upper end of the annular space, and at least one closeable passage arranged near the lower end of the annular space.

3. Marine riser system according to claim 1, wherein the risers are interconnected near their lower ends to prevent a relative axial displacement between the lower parts of the risers.

4. Marine riser system according to claim 1, wherein the risers are interconnected near their upper ends to prevent a relative axial displacement between the upper parts of the risers and wherein the sealing means arranged near the lower end of the annular space allow a relative axial displacement between the lower parts of the risers.

5. Marine riser system according to claim 1, wherein buoyancy means are attached to the outer wall of at least one of the risers.

6. Method for installing the marine riser system according to claim 1 between a floating drilling means and a submerged wellhead, comprising the steps of:

a. suspending the outer riser from the floating drilling means by means of a heave compensating system mounted on the floating drilling means, the lower end of the outer riser being above the submerged wellhead to which it is to be coupled;

b. placing the lower end of the outer riser on the wellhead and coupling this lower end of the outer riser to this wellhead;

c. lowering the inner riser through the outer riser to a position wherein the inner riser is enclosed by the outer riser, and sealing off the annular space between the outer and inner riser near both ends of this annular space; and d. manipulating the pressure equalizing means to equalize the fluid pressures prevailing in the annular space and outside the outer riser.

7. Marine riser system according to claim 1, wherein the sealing means that are arranged for sealing off the upper end of the annular space allow a relative axial displacement between the upper parts of the risers.

8. Marine riser system according to claim 7, wherein the sealing means arranged for sealing off the upper part of the annular space include a cylinder/piston arrangement adapted for tensioning the inner riser with respect to the outer riser by means of hydraulic fluid supplied to the cylinder means of the arrangement, said arrangement comprising at least one piston connected to one of the risers near the upper end thereof, and cylinder means connected to the other riser.

9. Marine riser system according to claim 8, wherein the piston is an annular piston mounted on the inner wall of the outer riser, and the cylinder means is connected to the inner riser by means of a remotely operable coupling.

10. Marine riser system according to claim 8, wherein the cylinder means are connected to the interior wall of the outer riser by means of a remotely-operable coupling.

11. Marine riser system according to claim 10, including a fluid passage way between the inner wall of the outer riser and the outer wall of the cylinder means, said passage way communicating at one end thereof with the cylinder means and at the other end with a conduit arranged at the outside of the outer riser.

12. Marine riser means according to claim 8, wherein the cylinder parts at opposite sides of the piston can be brought into communication with each other via a by-pass conduit.

13. Method for installing the marine riser system according to claim 12 between a floating drilling means and a submerged wellhead, the method comprising the steps of:

a. suspending the outer riser from the floating drilling means by means of a heave compensating system mounted on the floating drilling means, the lower end of the outer riser being above the wellhead to which it is to be coupled;

b. lowering a tubular member through the outer riser, coupling the tubular member to the cylinder means of which the parts situated at both sides of the piston are in communication with each other via a by-pass conduit, and landing the lower end of the tubular member on the wellhead, whereafter this end is coupled to the wellhead;

c. gradually closing the by-pass conduit, thereby activating the heave compensating system and maintaining the lower end of the outer riser at a fixed distance above the wellhead; supplying pressure fluid to one side of the piston after the by-pass conduit has been closed, to displace the outer riser downwards against the action of the heave compensating system until the lower end of the outer riser contacts the wellhead;

e. coupling the lower end of the outer riser to the wellhead;

f. removing the fluid pressure from the cylinder means, detaching the coupling between the tubular member and the cylinder means and lifting the tubular member aboard the floating drilling means;

g. supplying drilling mud to the interior of the outer riser, and carrying out drilling operations;

h. subsequently lowering the inner riser through the outer riser, connecting the lower end of the inner riser to the outer riser, and the upper end of the inner riser to the cylinder means;

i. admitting pressure fluid to one side of the piston in the cylinder means to tension the inner riser; and j. manipulating the pressure equalizing means after one of the steps (g) – (i) to equalize the fluid pressures prevailing in the annular space and outside the outer riser.

* * * * *